United States Patent [19]

Nelson

[11] Patent Number: 4,603,507

[45] Date of Patent: Aug. 5, 1986

[54] MULTI-TIER MULTI-UNIT POT HANGER ASSEMBLY

[76] Inventor: Paul W. Nelson, 28108 Mountain Meadow Rd., Escondido, Calif. 92026

[21] Appl. No.: 231,590

[22] Filed: Feb. 5, 1981

[51] Int. Cl.[4] ..... A47G 7/02

[52] U.S. Cl. ..... 47/67; 211/113; 248/318

[58] Field of Search ..... 47/67, 39; 248/318, 248/303, 302, 311, 312, 315; 211/119, 106, 181, 118, 113; 294/143, 159–163

[56] References Cited

U.S. PATENT DOCUMENTS

| | | | |
|---|---|---|---|
| 37,070 | 12/1862 | Crawford | 47/39 X |
| 313,667 | 3/1885 | Hesser | 248/318 |

FOREIGN PATENT DOCUMENTS

| | | | |
|---|---|---|---|
| 1039849 | 10/1953 | France | 248/311.3 |
| 1191245 | 10/1959 | France | 211/119 |
| 961081 | 6/1964 | United Kingdom | 248/318 |

*Primary Examiner*—Steven A. Bratlie

*Attorney, Agent, or Firm*—Brown, Martin & Haller

[57] ABSTRACT

A multi-tier multi-unit pot hanger assembly includes a first hanger member constructed of a unitary piece of wire and including a pot encircling loop and an upwardly extending arm with a hook for hooking on an overhead rack or the like, and a second hanger member including a loop and an upwardly extending arm that is angled inward to the center axis of the loop and includes a hook for hooking at the juncture of the arm and loop of the first hanger member. A plurality of the second members are adapted to hang from each previous or upper member to define an array of hangers in vertical tiers that are formed in a spiral arrangement such that no pot is directly over any other pot.

5 Claims, 6 Drawing Figures

16
18
10
14
12
20
22

12
16
14
12a 16
14
10
12

10
16
26
14
12
20
26
22
22
20

28
20
26
22
24

16
18
10
14
12
20
22
20
22

MULTI-TIER MULTI-UNIT POT HANGER ASSEMBLY

BACKGROUND OF THE INVENTION

The present invention relates to pot hangers and pertains particularly to a multi-unit, multi-tier pot hanger assembly.

Many flowers and other plants which are grown in pots are supported by wire hangers from overhead hangers or structures. Many such plants require hanging in order to avoid engagement of the plant with support structures such as tables, the ground or the like. Such plants are perferably supported by overhead wire hangers in greenhouses and the like rather than table supports.

Space in greenhouses is at a premium. It is therefore desirable that as many plants as possible be accomodated in a greenhouse. It is also desirable that individual plants be capable of being separated as a unit from other plants.

Pots that are hung in vertical tiers must be hung in an arrangement such that no pot is directly beneath another pot. This is necessary in order to prevent lower pots from receiving drain water from upper pots and the resultant damage that such can frequently cause.

It is therefore desirable that a pot hanger be available which permits multi-unit, multi-tier hanging of pots.

SUMMARY AND OBJECTS OF THE INVENTION

It is therefore the primary object of the present invention to provide an improved multi-tier, multi-unit pot hanger.

In accordance with the primary aspect of the present invention a multi-tier pot hanger is constructed of multiple units comprising a first holder member having a pot receiving loop and an upwardly extending arm for hooking on an overhead support structure, and a second holder member having a pot receiving loop and an upwardly extending arm with a hook for hooking to the upper hanger member.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figures 1, 2, 3, 4, 5, 6:
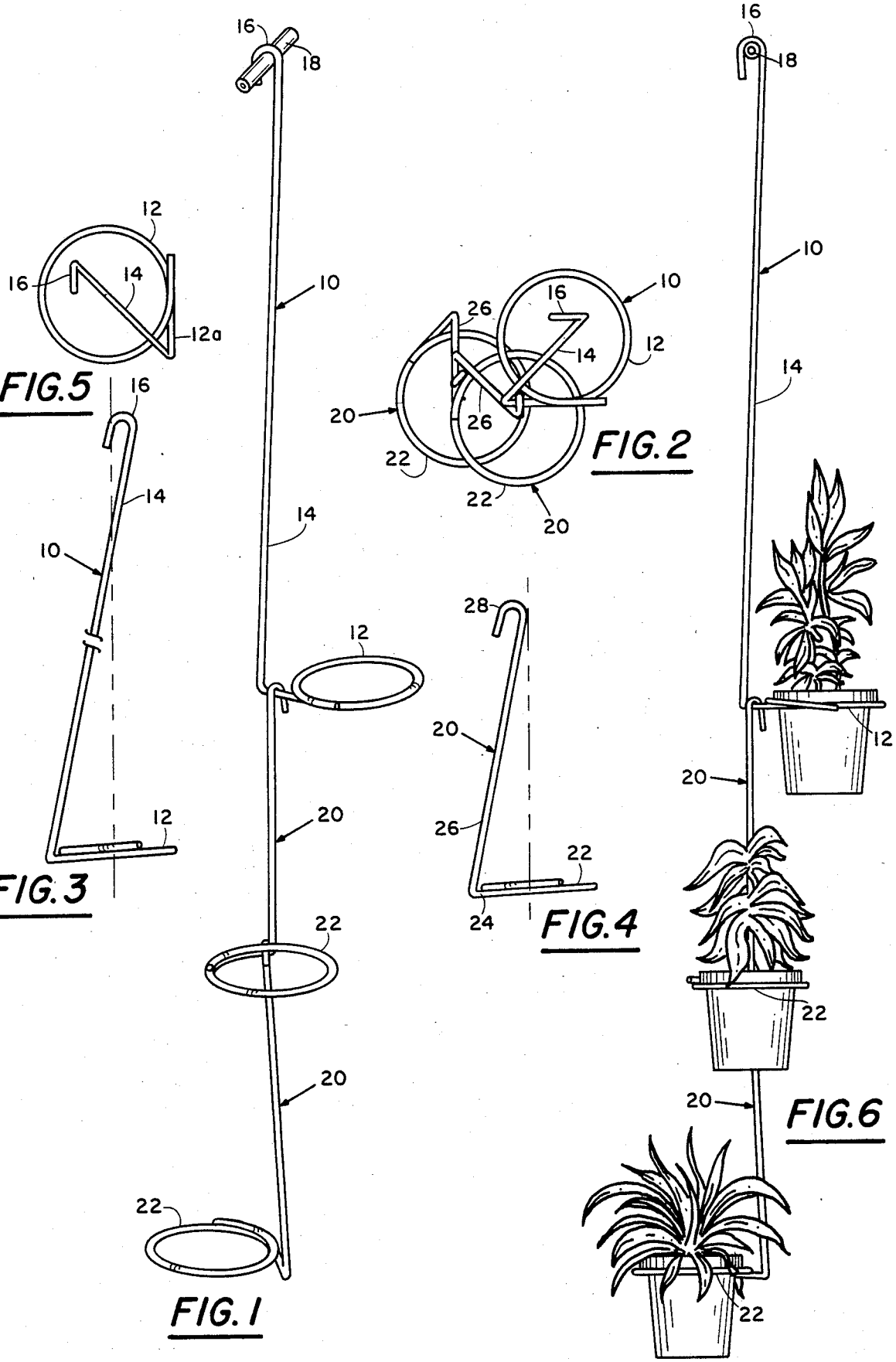
FIG. 1 is a perspective view of a preferred embodiment of the invention.
FIG. 2 is a top plan view of the embodiment of FIG. 1.
FIG. 3 is a side elevation view of one unit of the hanger assembly.
FIG. 4 is a side elevation view of the second unit of the hanger assembly.
FIG. 5 is a top elevation view of the member of FIG. 3.
FIG. 6 is a side elevation view of the assembly of FIG. 1.

Turning to FIG. 1 of the drawing there is illustrated a hanger assembly in accordance with the present invention comprising an upper hanger member 10 comprising a horizontally extending loop 12 having a vertical arm 14 and upper hook 16. The upper hanger member is constructed of a unitary or single continuous piece of wire with the lower end of the wire formed in a loop with the end overlying a portion of the loop adjacent the upwardly extending arm 14 for support. The upwardly extending arm 14 extends at an angle to the horizontal plane of the loop 12 such that the hook is disposed substantially at the center axis of the loop 12. The loop 12 includes a portion 12*a* extending outward therefrom forming a short horizontal arm at the juncture of the upwardly extending arm 14 (FIG. 5) to receive the hook of a second hanger member such as illustrated in FIGS. 1 and 6.

This second hanger member, as in the previous embodiment, includes a single wire member shaped to form a lower horizontally extending loop 22 formed substantially as in the previous embodiment and including an outwardly extending arm 24 from which an upwardly extending arm 26 extends and terminates in an upper hook 28. The arm 26 extends upwardly at an angle to the arm 24 and the plane of the loop 22 such as to terminate in hook 28 at a point coaxially of the loop 22. This permits the hanger when balanced with a pot to balance such that the weight is substantially directly beneath the hook 28. The hook 28 as will be seen in FIG. 6 extends in a plane that is tangent to the loop 22 at the position of arm 24 such that the hook when hooked on arm 12*a* of the upper member 10 will be offset to one side of the upper loop 12 such that it will not lie beneath the center axis thereof. A plurality of the members 20 may hang downward from each respective upper member thus forming a substantially spiral array such that no loop or pot and loop for that matter will fall directly beneath an upper loop for a given minimum number of the hanger members. It is apparent that once a certain number of the members are exceeded, the loops will begin falling beneath an upper loop.

The hooks are formed such that the primary member 10 has a large curved hook to hook over an overhead pipe or hanging member 18 as illustrated in FIG. 1. The lower members are adapted to hook only on an upper hanger and not to hook over a large pipe or rod. Thus, each assembly will consist of a single upper member 10 and a plurality of identical lower or second members 20. This arrangement permits very close and compact stacking of pots and plants in a greenhouse or other storage facility. Thus, an overhead rack can be provided for a single upper hanger member with a plurality of lower members hanging successively downward to just above the floor level. Thus a single closed columnar space can hold and receive a number of pots hung in a tier downward within the column. While the arrangement in FIGS. 1 and 6 show a single upper member and two lower hanger members, any number of the lower members may be hung in succession to form a vertical column of the desired height. This also permits the plants to be easily removed from a column simply by unhooking and taking out the desired plant.

This arrangement also permits the easy caring of plants within a greenhouse. For example, rows of columns may be formed such that watering of all plants can be carried out simply from a isle-way between rows. This eliminates racks and tables normally employed in greenhouses and considerably increases the capacity of a given space as well as the accessibility to the plants within the space.

The units are simple and inexpensive to construct simply requiring a single strand or length of wire, preferably of sufficiently heavy gauge (e.g. about ⅛ inch diameter) that welding of the portions of the loop together is not required. Preferably a heavy gauge of wire sufficient to support the pot without the necessity of welding the lower end of the wire within the loop member. The loop is preferably constructed such that the loop end of the wire overlaps a portion of the loop such that it is supported thereon. While this is not essential to the construction or the stability thereof, such can add to the stability and strength where necessary.

The vertical arm 14 of hanger member 10 is preferably on the order of about two times the length of the vertical arm 26 of the lower member 20. The hooks 16 of the upper member 10 and 28 of the lower member 20 are preferably curved to lie in the plane of or parallel to the arms 12*a* and 24 respectively.

Thus, while I have illustrated and described my invention by means of particular embodiments, it is to be understood that numerous changes and modifications may be made therein without departing from the spirit and scope of the invention as defined in the appended claims.

I claim:

1. A multi-tier multi-unit pot hanging assembly for hanging a plurality of planter pots in a vertically tiered arrangement comprising in combination:

a first hanger member for hanging from an overhead rack, and at least one second hanger member for hanging from said first hanger member;

said first hanger member defined by a first loop having, a first horizontal arm integral with and extending outwardly from one side of said first loop, and an upwardly extending first vertical arm extending upward from the outer end of said first horizontal arm at an angle of less than 90 degrees to the plane of sid first loop and having a first hook at the upper end thereof terminating at a point coaxial of said loop and adapted to hook over an overhead rail, said first loop extending outward from said first horizontal arm in a horizontal plane for receiving and supporting a planter pot in an upright position; and said second hanger member defined by a second loop having an upwardly extending second vertical arm extending upwardly from one side of said loop at an angle of less than 90 degrees to the plane of said second loop for supporting said second loop in a horizontal plane for receiving and supporting a planter pot in an upright position and said second vertical arm terminating in a second hook at the upper end at a point substantially coaxial of said second loop for hooking on the outwardly extending first horizontal arm of said first hanger member and thereby position said second loop offset from the axis of said first loop.

2. The multi-tier pot hanger of claim 1 wherein said first hook lies in a plane parallel to said outwardly extending first horizontal arm.

3. The multi-tier pot hanger of claim 1 wherein said second hanger member includes a second horizontal arm extending outward from one side of said second loop, and said upwardly extending second vertical arm extends upwardly from the outer end of said second horizontal arm and has a length of about one-half the length of said first vertical arm.

4. The multi-tier pot hanger of claim 3 including a plurality of said second hanger members one of said second hanger members for hanging from said first horizontal arm, and at least another of said second hanger members for hanging from said horizontal arm of said one second hanger member.

5. The multi-tier pot hanger of claim 3 wherein said first and said second members are each constructed of a continuous unitary piece of wire having an end terminating at the loop of the respective first and second member overlying the outwardly extending first and second arms, respectively, and an end terminating at the termination of the respective first and second hook.

* * * * *